US010184479B2

(12) United States Patent
Xu

(10) Patent No.: US 10,184,479 B2
(45) Date of Patent: Jan. 22, 2019

(54) MULTI-USE FAN

(71) Applicant: Wenlong Xu, Shenzhen (CN)

(72) Inventor: Wenlong Xu, Shenzhen (CN)

( * ) Notice: Subject to any disclaimer, the term of this patent is extended or adjusted under 35 U.S.C. 154(b) by 228 days.

(21) Appl. No.: 15/023,037

(22) PCT Filed: Mar. 5, 2015

(86) PCT No.: PCT/CN2015/073669
§ 371 (c)(1),
(2) Date: Mar. 18, 2016

(87) PCT Pub. No.: WO2016/127454
PCT Pub. Date: Aug. 18, 2016

(65) Prior Publication Data

US 2016/0356279 A1 Dec. 8, 2016

(30) Foreign Application Priority Data

Feb. 11, 2015 (CN) ..... 2015 1 0073619

(51) Int. Cl.
*F04D 25/08* (2006.01)
*F04D 29/32* (2006.01)
*F04D 29/52* (2006.01)
*F04D 29/64* (2006.01)

(52) U.S. Cl.
CPC ..... *F04D 25/084* (2013.01); *F04D 29/327* (2013.01); *F04D 29/522* (2013.01); *F04D 29/644* (2013.01)

(58) Field of Classification Search
CPC .... F04D 25/084; F04D 29/522; F04D 29/644; F04D 29/327; F04D 25/0673; F04D 29/40; F04D 29/403; F04D 29/4226
USPC ..... 417/234, 411, 423.14
See application file for complete search history.

(56) References Cited

U.S. PATENT DOCUMENTS 3,285,187 A * 11/1966 Anderson, Jr. ..... F04D 29/2222 29/889.4
5,295,811 A * 3/1994 Chiu ..... F04D 25/08 248/127
5,667,732 A * 9/1997 Lederer ..... B01F 3/04035 239/222.11
6,378,845 B1 * 4/2002 Hsu ..... F24F 6/00 239/222.11

(Continued)

*Primary Examiner* — Dominick L Plakkoottam
*Assistant Examiner* — Stephen A Mick

(57) ABSTRACT

A multi-use fan includes a front fan cover, a rear fan cover, blades, a motor, and a handle. The front and rear fan covers fit together to form a fan cover, a protrusion mirrored along the center line of the fan cover and disposed on the bottom thereof, a foldable connecting part disposed on the bottom of the rear fan cover, a foldable mounting part fitted with the foldable connecting part and disposed on the top of the handle. The handle includes a handle housing, a battery, a battery cover, a line group, an adjusting knob, an anti-slip pad rotationally connected with the side of the handle housing and formed at the highest point thereof, and an elastic metal bar including a short edge rotationally connected with the side of the handle housing and a long edge connected with the upper end face of the handle housing. The battery, the line group and the adjusting knob are disposed inside the handle housing, with an opening set in the handle housing at a position corresponding to the adjusting knob.

7 Claims, 5 Drawing Sheets

(56) References Cited

U.S. PATENT DOCUMENTS

2012/0321481 A1* 12/2012 DeJesus ..... F03B 3/126
416/241 R
2014/0205479 A1* 7/2014 Wark ..... F04D 25/0673
417/411

* cited by examiner

MULTI-USE FAN

TECHNICAL FIELD

The present invention relates to the field of household appliances, and in particular, to a multipurpose fan.

BACKGROUND

As a common household appliance, fans have a history of over 100 years. The varieties of small fans are increasing along with technological advancement. However, neither ordinary household fans nor various types of existing small fans can meet people's needs for both portability and diversified cooling functions. Therefore, a portable electricity-driven fan that has persistent power and can be used in various special scenarios such as strollers and umbrellas is required.

SUMMARY

An objective of embodiments of the present invention is to provide a type of multipurpose fan, so as to resolve a problem with an existing technical solution that a fan is not portable and cannot be applied to a variety of scenarios.

According to a first aspect, a type of multipurpose fan is provided. The fan comprises a front fan cover, a rear fan cover, blades, and a motor, and the fan further comprises a handle. The front fan cover and the rear fan cover fit together to form a fan cover; a protrusion mirrored along the center line of the fan is disposed on the bottom of the fan cover; a foldable connecting part is disposed on the bottom of the rear fan cover; a foldable mounting part that can be fitted with the foldable connecting part is disposed on the top of the handle.

The handle further comprises a handle housing, a battery, a battery cover, a line group, an adjusting knob, an anti-slip pad, and an elastic metal bar, where the battery, line group, and adjusting knob are disposed inside the handle housing, an opening is set in the handle housing at a position corresponding to the adjusting knob, and the elastic metal bar comprises a short edge and a long edge. The short edge is connected rotationally with the side of the handle housing, and the long edge is connected with the upper end face of the handle housing. An anti-slip pad is disposed on the upper end face of the handle housing. The anti-slip pad is the highest point on the upper end face of the handle housing.

Optionally, the elastic metal bar has a double-L-shaped frame structure, where, the horizontal axis side of the short edge of the double-L-shaped frame structure has an opening and the vertical axis side of the short edge of the double-L-shaped frame structure has two symmetrical clamping apparatuses. The clamping apparatus comprises a telescopic pole and a clip, one end of the telescopic pole is fixed on the vertical axis side and the other end is connected to the upper end of the clip.

Optionally, the blades specifically comprise three large blades and three small blades, the blades are evenly distributed in 360 degrees, and the three large blades and three small blades are disposed alternately.

Optionally, hook-shaped buckle positions are disposed on the lower surface of the rear fan cover. The hook-shaped buckle positions are disposed on the two sides of the rear fan cover in a symmetrical manner.

According to the embodiments of the present invention, the present invention provides a technical solution for a multipurpose fan, which can be used in various scenarios and is highly portable.

DETAILED DESCRIPTION OF THE INVENTION

To make the objectives, technical solutions, and advantages of the present invention clearer, the following further describes the present invention in detail with reference to the accompanying drawings and embodiments. It should be understood that the specific embodiments described herein are merely used to explain the present invention but are not intended to limit the present invention.

Figure 1:
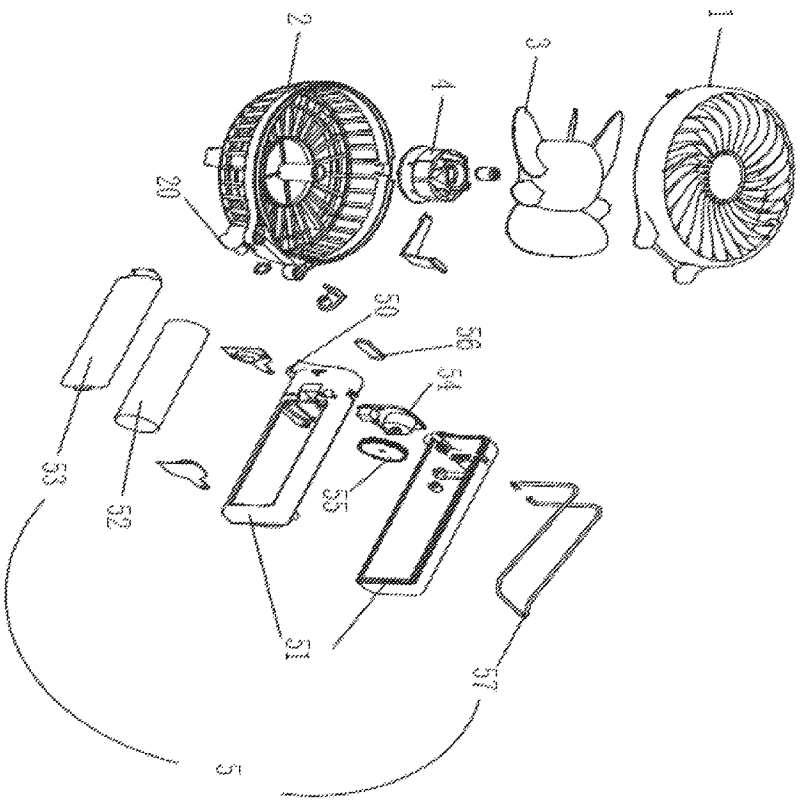
FIG. 1 is an exploded diagram of a multipurpose fan according to an embodiment of the present invention.

An embodiment of the present invention provides a type of multipurpose fan. As shown in FIG. 1, the fan comprises a. front discoid fan cover 1, a rear discoid fan cover 2, blades 3, a motor 4. and a handle 5. The front discoid fan cover 1 and the rear discoid fan cover 2 fit together to form a discoid fan cover for receiving the blades 3 and the motor 4 therein; a protrusion 6 mirrored along the center line of the discoid fan cover is disposed on the bottom of the discoid fan cover, a foldable connecting part 20 is disposed on the bottom of the rear discoid fan cover 2, and a foldable mounting part 50 that can be fitted with the foldable connecting part 20 is disposed on the top of the handle 5.

Figure 3:
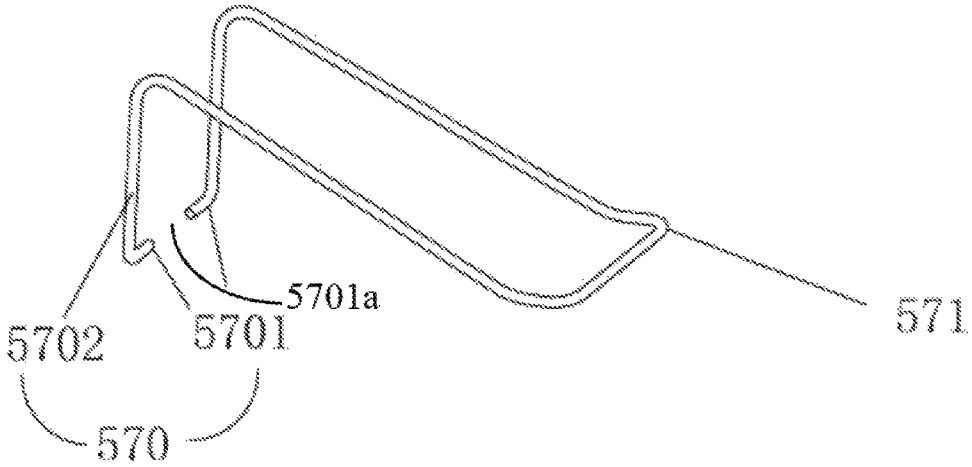
FIG. 3 is a schematic structural diagram of an elastic metal bar according to the present invention.

The handle 5 further includes a handle housing 51, a battery 52, a battery cover 53, a line group 54, an adjusting knob 55, an anti-slip pad 56, and an elastic metal bar 57, wherein the battery 52, the line group 54, and the adjusting knob 55 are disposed inside the handle housing 51, an opening 51*a* is set in the handle housing 51 at a position corresponding to the adjusting knob 55, and the elastic metal bar 57 (as shown in FIG. 3) includes a short edge 570 and a long edge 571. The short edge 570 is connected rotationally with two opposite longitudinal sides 51*b* of the handle housing 51, with the two longitudinal sides perpendicular to the rear fan cover, and the long edge 571 is connected with an upper end face 51*c* of the handle housing 51. An anti-slip pad 56 is disposed on a top end face 51*d* of the handle housing 51. The anti-slip pad 56 is the highest point on the top end face 51*d* of the handle housing 51. In the present disclosure, the upper end face 51*c* is formed between the two opposite longitudinal sides 51*b* and is arranged farther away from the rear fan cover 2 than a lower end face 51*e* of the handle housing 51. The top end face 51*d* is a lateral surface and perpendicularly connected the two opposite longitudinal sides 51*b* and the upper end face 51*c*.

Figure 2:
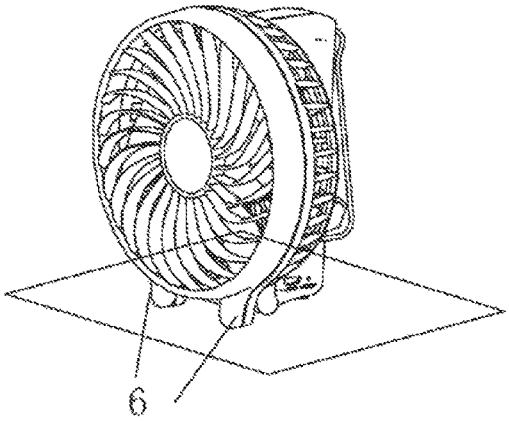
FIG. 2 is a schematic usage diagram of a folded multipurpose fan according to the present invention.

According to the technical solution provided in the present invention, the battery line group is disposed inside the handle to make the product more compact. The battery is a lithium battery that can be recharged and reused to save energy and protect the environment. The line group uses an adjusting knob to control the blowing rate. The handle 5 is designed to be foldable for portability. In addition, the anti-slip pad 56 is disposed on the handle housing, so that the anti-slip pad 56 and the foldable mounting part 50 together create a three-point support (as shown in FIG. 2) when the handle 5 is folded for stabilizing the fan. In addition, the elastic metal bar 57 is disposed on the fan for clamping purposes in scenarios such as strollers to ensure higher applicability.

Optionally, the elastic metal bar 57 (as shown in FIG. 3) has a double-L-shaped frame structure, where the horizontal axis side 5701 of the short edge 570 of the double-L-shaped frame structure has an opening 5701*a* and the vertical axis side 5702 of the double-L-shaped frame structure has two symmetrical clamping apparatuses. The clamping apparatus includes a telescopic pole and a clip, one end of the telescopic pole is fixed on the vertical axis side 5702 and the other end is connected to the upper end of the clip. The two clamping apparatuses are used to fix the fan. If only the double-L-shaped frame structure is used to clamp the fan, the fan may slide easily because the fan vibrates significantly when it is operational. After two clamping apparatuses are added to the short axis side to increase the number of clamping points to three, a more table clamping effect can be achieved. The telescopic poles are used to address different height requirements for higher applicability.

Figure 4:
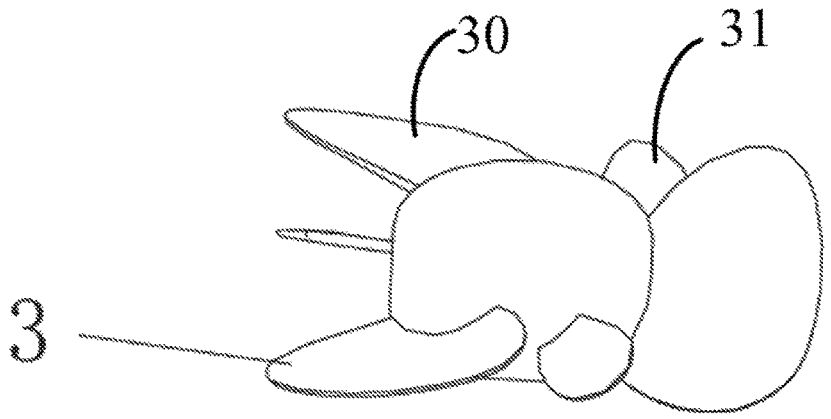
FIG. 4 is a schematic structural diagram of blades according to the present invention.

Optionally, the blades 3 (as shown in FIG. 4) specifically include three large blades 30 and three small blades 31. The blades 30, 31 are evenly distributed in 360 degrees, and the three large blades 30 and three small blades 31 are disposed alternately. The blades can achieve an energy saving and balancing effect. The three alternated small blades 31 are used to increase the blowing rate of the fan without affecting the energy saving and balancing effect.

Figure 5:
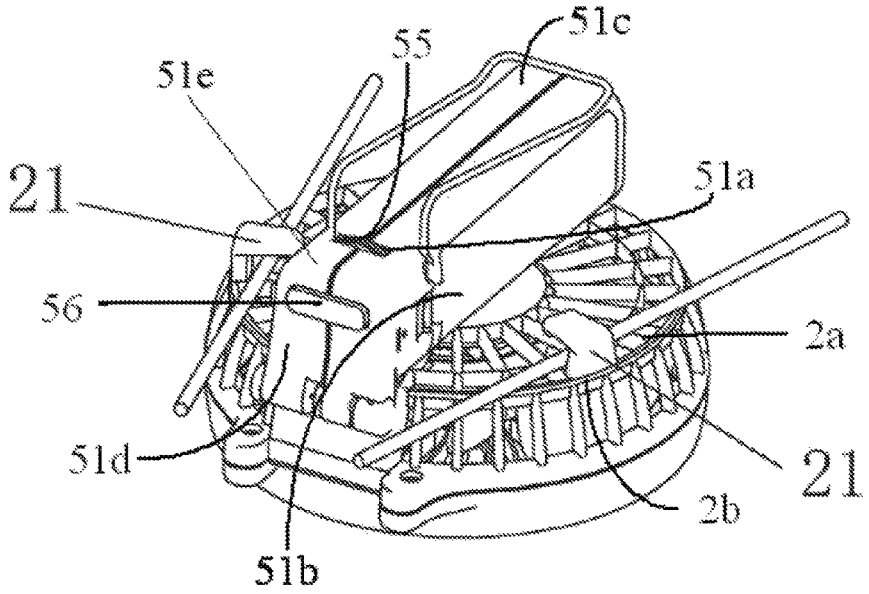
FIG. 5 is a schematic structural diagram of buckle positions according to the present invention.

Optionally, hook-shaped buckle positions 21 are disposed on a lower surface 2*a* of the rear fan cover 2. The hook-shaped buckle positions 21 are disposed on the two opposite sides 2*b* of the rear fan cover 2 in a symmetrical manner. In the present disclosure, the two opposite sides 2*b* of the rear fan cover 2 are formed close to the foldable connecting part 20. After the hook-shaped buckle positions are disposed, the compatible V-shaped aperture hanging solution for umbrellas (as shown in FIG. 5) can be used. The V-shaped aperture buckle positions on the left and right can be used to hang the fan on the ribs of an umbrella and the V-shaped aperture design makes the fan compatible with different sizes of umbrellas, so that it serves multiple purposes.

The metal clamping solution adopts a design that leverages a metal bar and a handle to form an included angle. The metal bar is elastic and can be used to clamp different sizes of objects for different purposes after the included angle is formed. In addition, if the clamping function is not required, the metal bar can be removed.

Figure 6:
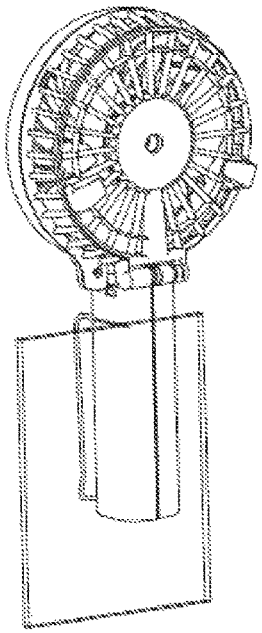
FIG. 6 is a first use state diagram of a fan according to the present invention.
Figure 7:
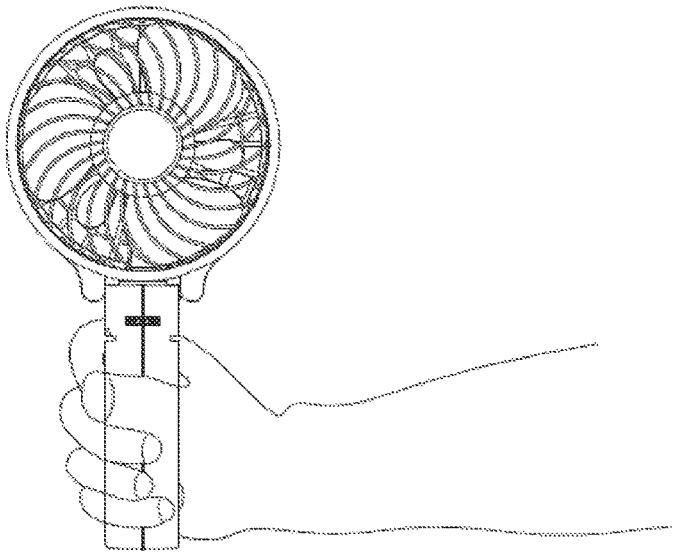
FIG. 7 is a second use state diagram of a fan according to the present invention.
Figure 8:
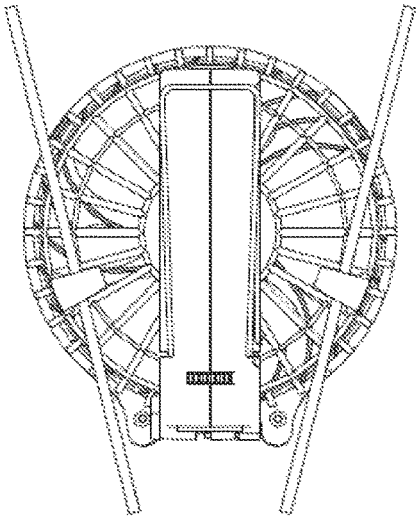
FIG. 8 is a third use state diagram of a fan according to the present invention.

FIG. 6, FIG. 7, and FIG. 8 show multiple states of the fan according to the present invention.

The foregoing descriptions are merely exemplary embodiments of the present invention, but are not intended to limit the present invention. Any modifications, equivalent replacements, or improvements that are made within the spirit and principles of the present invention should fall within the protection scope of the present invention.

What is claimed is:

1. A multi-use fan comprising: a front discoid fan cover, a rear discoid fan cover, blades, a handle, and a motor, wherein:

the front discoid fan cover and the rear discoid fan cover fit together to form a discoid fan cover for receiving the blades and the motor therein; a protrusion mirrored along the center line of the fan cover is disposed on the bottom of the fan cover; a foldable connecting part is disposed on the bottom of the rear discoid fan cover, and a foldable mounting part that can be fitted with the foldable connecting part is disposed on the top of the handle; and wherein the handle further comprises a handle housing, a battery, a battery cover, a line group, an adjusting knob, an anti-slip pad, and an elastic metal bar, wherein the battery, the line group, and the adjusting knob are disposed inside the handle housing, an opening is set in the handle housing at a position corresponding to the adjusting knob, and the elastic metal bar rotationally connected with the handle housing and clampable to an external structure via a elasticity of the elastic metal bar, the elastic metal bar comprising a short edge and a long edge, wherein the short edge is connected rotationally with two opposite longitudinal sides of the handle housing, with the two longitudinal sides perpendicular to the rear discoid fan cover, and the long edge is connected with an upper end face of the handle housing; the anti-slip pad is disposed on a top end face of the handle housing and formed at the highest point on the top end face of the handle housing, wherein the anti-slip pad and the foldable mounting part are structured and configured together to create a three-point support when the handle is folded; wherein the upper end face is formed between the two opposite longitudinal sides and is arranged farther away from the rear fan cover than a lower end face of the handle housing, the top end face is a lateral surface and perpendicularly connected the two opposite longitudinal sides and the upper end face.

2. The multi-use fan according to claim 1, wherein the elastic metal bar has a double-L-shaped frame structure, wherein the horizontal axis side of the short edge of the double-L-shaped frame structure has an opening and the vertical axis side of the short edge of the double-L-shaped frame structure has two symmetrical clamping apparatuses, wherein the clamping apparatus comprises a telescopic pole and a clip, one end of the telescopic pole is fixed on the vertical axis side and the other end is connected to the upper end of the clip.

3. The multi-use fan according to claim 1, wherein the blades specifically comprise three large blades and three small blades, the blades are evenly distributed in 360 degrees, and the three large blades and the three small blades are disposed alternately.

4. The multi-use fan according to claim 1, Wherein hook-shaped buckle positions are disposed on the lower surface of the rear fan cover, and the hook-shaped buckle positions are disposed on two opposite sides of the rear fan cover in a symmetrical manner so that a compatible V-shaped aperture positions on the left and right can be used to hang the fan on the ribs of an umbrella and the V-shaped aperture design makes the fan compatible with different sizes of umbrellas, with the two opposite sides of the rear fan cover formed close to the foldable connecting part.

5. A multi-use fan applied to a variety of scenarios, the multi-use fan comprising:

a front discoid fan cover;

a rear discoid fan cover fit with the front discoid fan cover to form a discoid fan cover and comprising a protrusion mirrored along the center line of the discoid fan cover and disposed on the bottom of the discoid fan cover, and a foldable connecting part disposed on the bottom thereof;

a plurality of blades received in the discoid fan cover and comprising three large blades and three small blades, the plurality of blades evenly distributed in 360 degrees, and the three large blades and the three small blades alternately disposed each other;

a motor engaged with the plurality of blades and received in the discoid fan cover;

a handle foldable for portability and connected to the discoid fan cover, the handle comprising a foldable mounting part disposed on the top thereof to engage with the foldable connecting part; and the handle further comprising a handle housing, a battery, a battery cover, a line group, an adjusting knob, an anti-slip pad, and an elastic metal bar; the battery, the line group and the adjusting knob disposed inside the handle housing, an opening set in the handle housing at a position corresponding to the adjusting knob; and wherein the elastic metal bar is rotationally connected with the handle housing for clamping purposes in scenarios such as strollers to ensure higher applicability, and comprises a short edge rotationally connected with two opposite longitudinal sides of the handle housing, with the two longitudinal sides perpendicular to the rear discoid fan cover, and a long edge connected with an upper end face of the handle housing; while the anti-slip pad is disposed on a top end face of the handle housing and formed at the highest point on the top end face of the handle housing so that the anti-slip pad and the foldable mounting part together create a three-point support when the handle is folded for stabilizing the fan; wherein the upper end face is formed between the two opposite longitudinal sides and is arranged farther away from the rear discoid fan cover than a lower end face of the handle housing, the top end face is a lateral surface and perpendicularly connected to the two opposite longitudinal sides and the upper end face.

6. The multi-use fan according to claim 5, wherein the elastic metal bar is a double-L-shaped frame structure, the horizontal axis side of the short edge of the double-L-shaped frame structure has an opening and the vertical axis side of the short edge of the double-L-shaped frame structure has two symmetrical clamping apparatuses, while the clamping apparatus comprises a telescopic pole and a clip, one end of the telescopic pole is fixed on the vertical axis side and the other end is connected to the upper end of the clip.

7. The multi-use fan according to claim 6, wherein hook-shaped buckle positions are disposed on two opposite sides of the rear fan cover in a symmetrical manner so that a compatible V-shaped aperture positions on the left and right can be used to hang the fan on the ribs of an umbrella and the V-shaped aperture design makes the fan compatible with different sizes of umbrellas, with the two opposite sides of the rear fan cover formed close to the foldable connecting part.

* * * * *